US005996300A

United States Patent [19]

Hamlin

[11] Patent Number: 5,996,300

[45] Date of Patent: Dec. 7, 1999

[54] ROLLED SHINGLE ROOFING MATERIAL AND METHOD OF INSTALLATION

[76] Inventor: H. Lee Hamlin, 2935 Broadway, Macon, Ga. 31206

[21] Appl. No.: 08/934,554

[22] Filed: Sep. 22, 1997

[51] Int. Cl.[6] ..... E04D 5/12; E04D 5/08

[52] U.S. Cl. ..... 52/559; 52/314; 52/555; 428/906

[58] Field of Search ..... 52/518, 523, 524, 52/528, 748.1, 749.13, 558, 559, DIG. 16, 554, 555, 557, 314, 315, 749.12; 428/906

[56] References Cited

U.S. PATENT DOCUMENTS

| | | | |
|---|---|---|---|
| 4,686,809 | 8/1987 | Skelton | 52/528 |
| 4,757,652 | 7/1988 | Kalkanoglu | 52/DIG. 16 |
| 4,848,057 | 7/1989 | MacDonald et al. | 52/558 |
| 5,037,685 | 8/1991 | Richards et al. | 52/518 |
| 5,239,802 | 8/1993 | Robinson | 52/518 |
| 5,548,940 | 8/1996 | Baldock | 52/518 |

*Primary Examiner*—Michael Safavi
*Attorney, Agent, or Firm*—Harry I. Leon

[57] ABSTRACT

An assembly including rolled shingle roofing material that can be easily installed on a roof and a special handling tool. The tool reduces the strain of carrying the roofing material and of raising to the roof. The roofing material includes a membrane attached by pressure-sensitive adhesive to a plurality of standard flat roofing shingles so as to create a continuous array of shingles which can be formed into a roll or rolled onto a spool. This membrane also serves as a release sheet to prevent thermally-activated adhesive present on the shingles from causing them to stick together in the roll. Alternately, roofing material pre-cut with slots to resemble shingles is rolled together with a release sheet placed on the bottom of the material so as to isolate a thermally-activated adhesive applied thereto from other surfaces. In the assembly, either type of roofing material can be used with the special handling tool. This tool includes a "U"-shaped tube in which one of its branches is inserted through a hollow core formed by the rolled roofing material itself or, alternately, a hollow cylinder upon which material has been wound. The branch of the "U"-shaped tube so inserted can then be used as an attachment point for a rope, useful in raising the roll of roofing material to the roof. Or one can use the distal end of the "U"-shaped tube as a handle to facilitate carrying the rolled roofing material and placing it on the roof.

7 Claims, 5 Drawing Sheets

ROLLED SHINGLE ROOFING MATERIAL AND METHOD OF INSTALLATION

BACKGROUND OF THE INVENTION

This invention relates to roofing materials and their installation.

In the past, shingles made of asphalt, fiberglass, and the like have been provided in flat packages. Each of these shingles typically measures about 3 feet long and about 1 foot wide and is precut so as to form two parallel slits. Extending about half way across the shingle from one of its longitudinal edges, the slits are disposed about a foot apart and divide the roofing material into three tabs. The remainder of the shingle, also known as the uncut slip, includes a face which is usually coated with a thermally activated adhesive material. Activated when the shingles are exposed to the sun, this adhesive is used to hold the shingles in an overlapping arrangement, with one shingle partially covering the other. The shingles are made so that when they are properly installed, the top shingle covers about one-half the transverse width of the bottom shingle and the slits in contiguous overlapping shingles do not align with each other.

When standard shingles are packaged for sale, they are sold in stacks of about 27 shingles which cover approximately 33.75 square feet. A protective sheet of plastic or waxed paper is placed between contiguous pairs of shingles to keep the adhesive from bonding them together before use. This protective sheet is thrown away as the shingles are being unstacked during placement.

During a roofing job, it is customary for the workmen to carry an unopened stack of shingles up a ladder, open the package on the roof, remove the shingles one at a time, place them in position and then nail or staple them in place. This procedure tends to generate problems. They arise, in part, because the weight of the shingle package, which is about 70 pounds, and its awkward shape makes carrying the shingles up a ladder difficult. Also, a stack of shingles resting on a sloping roof can easily slide off of it. Further, individually placing each shingle is a time-consuming chore.

SUMMARY OF THE INVENTION

The object of this invention is to provide a shingle that is easier to handle and install. A further object is to provide an inexpensive tool to facilitate lifting shingles to the roof and placing them there.

In accordance with the present invention, there is provided an improved roofing material in which individual shingles are held together, end to end, by a plastic joining membrane that serves both as a connector and as a separator to isolate a thermally-activated adhesive which has been pre-applied to certain portions of the shingles.

Prior to installation, the roofing material is preferably rolled around a hollow tube to facilitate storage and transport. The individual shingles, which can be of a type currently being marketed in stacks as flat sheets, are fabricated from a material which is sufficiently flexible to tolerate rolling. Unlike the shingles in the past which were of a thick brittle material which would have cracked or otherwise broken if rolling were attempted, new materials now used in the manufacture of shingles make rolling them practicable. Moreover, the connector, which is preferably not removed prior to shingle placement, adds to the shear resistance of individual shingles.

To facilitate lifting the improved roofing material to the roof and installing it, there is provided a handling tool including a tube bent into a "U"-shape defining first and second branches and a pair of cylindrical disks each having a centrally disposed hole formed therein for receiving one of the branches of the "U". In use, the disks are held at the ends of the hollow core of a roll of the roofing material and said branch, inserted through the hollow core and both disks, is held in assembled relation with them by a cap which threadedly engages the end of the tube distal from its handle. In addition, means for attaching a rope such as an eyelet is preferably affixed to the cap.

A roll of improved roofing can be lifted to the roof either by using the handle of the handling tool to carry it or by attaching a rope to the eyelet. With the latter approach, a worker on the roof can easily pull up the roll. Once on the roof, the roll is opened in the area where it is to be installed and fastened to the roof as it is unrolled.

In an alternate embodiment of this invention, there is provided a continuous roll of roofing material rather than individual shingles connected by a plastic joining membrane. Similar in appearance to that of the preferred embodiment, this version can use a narrowband release sheet to keep adhesive which has been pre-applied to an upper portion of the roofing material from bonding to other portions thereof while the rolled roofing material awaits installation. This material can be wound on a hollow core spool which can then be used with the "U"-shaped tube and cap attachment of the handling tube described hereinabove.

DESCRIPTION OF THE PREFERRED EMBODIMENT

Figure 1:
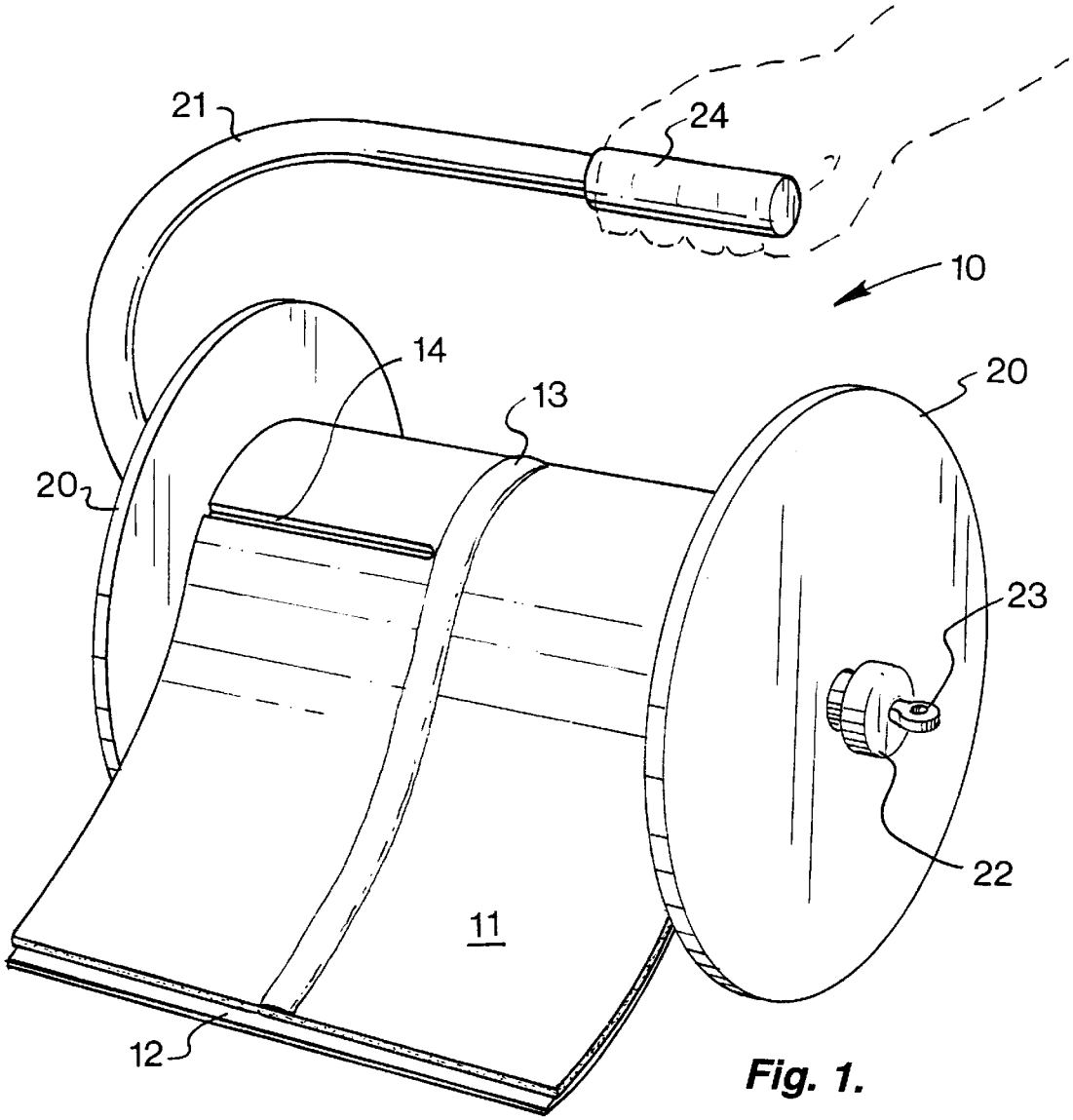
FIG. 1 is a perspective view of a roll of shingle roofing material and a handling tool therefor according to the present invention, the roofing material being shown partly unrolled with the remainder thereof mounted on the handling tool; the dashed outline of a worker's hand being shown for illustrative purposes only.

In accordance with the present invention, an assembly, which is indicated generally by the reference numeral 10, comprises roofing material formed from an array of shingles 11 joined together by a membrane 12 and means for handling the roofing material when it formed into a roll. The shingles 11 individually measure, by way of example, about three feet in length and one foot in width. The membrane 12 also serves as a release sheet to keep a thermally-activated adhesive coating 13 pre-applied to the shingles from joining together contiguous layers of shingles when they are stored in a roll. Moreover, the membrane 12 is preferably left in place during installation so that the individual shingles 11 can be held together as an array making placement of each of the shingles 11 easier.

Figure 3:
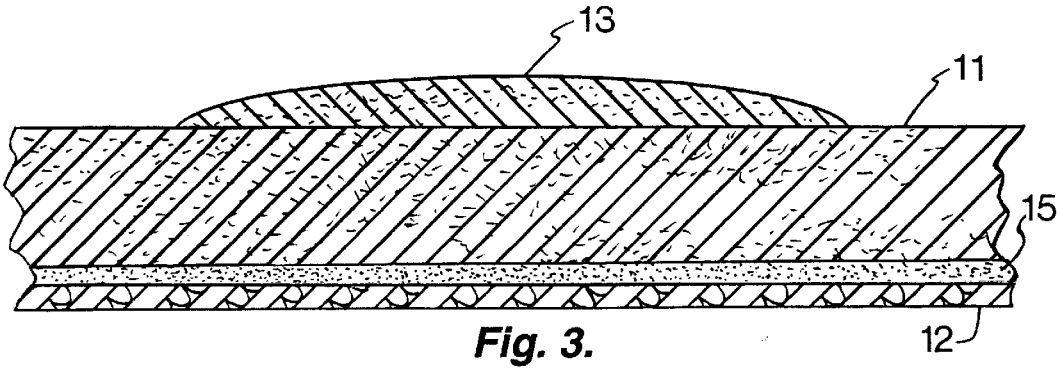
FIG. 3 is an enlarged transverse cross-section of the shingle roofing material.

The individual shingles 11 are fabricated from a material which is sufficiently flexible to tolerate rolling. Experience has shown that shingles formed of fiberglass-reinforced bituminous material or the like, which are currently being marketed in stacks as flat sheets, can be joined to a membrane 12 fabricated of vinyl, polypropylene, fiberglass or the like and a pressure-sensitive adhesive 15 (FIG. 3). Specifically, tests have shown that the fiberglass-reinforced shingles manufactured by Manville are satisfactory. Once these shingles 11 and the membrane 12 have been so joined, they can be rolled on a hollow cylinder which is about 5 inches in diameter. Preferably, a finished roll of the roofing material 10 has a cylindrical shape and measures about 1 foot high and about 12 inches in diameter; but rolls with other diameters can also be used.

Figure 2:
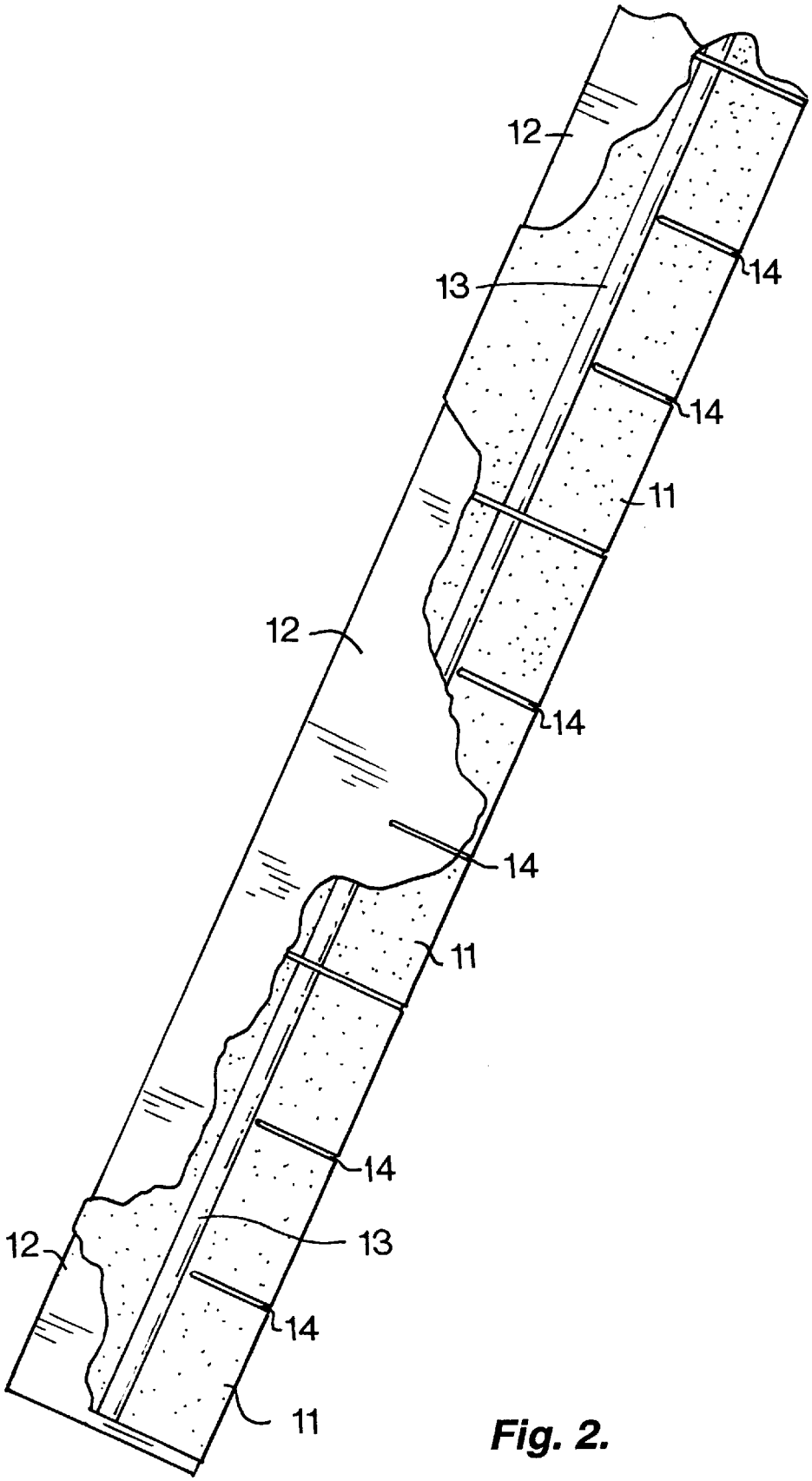
FIG. 2 is a plan view, on a reduced scale, of a fragmentary portion of the shingle roofing material according to FIG. 1 in an unrolled state, sections of the joining membrane having been broken out for the sake of illustration.
Figure 4:
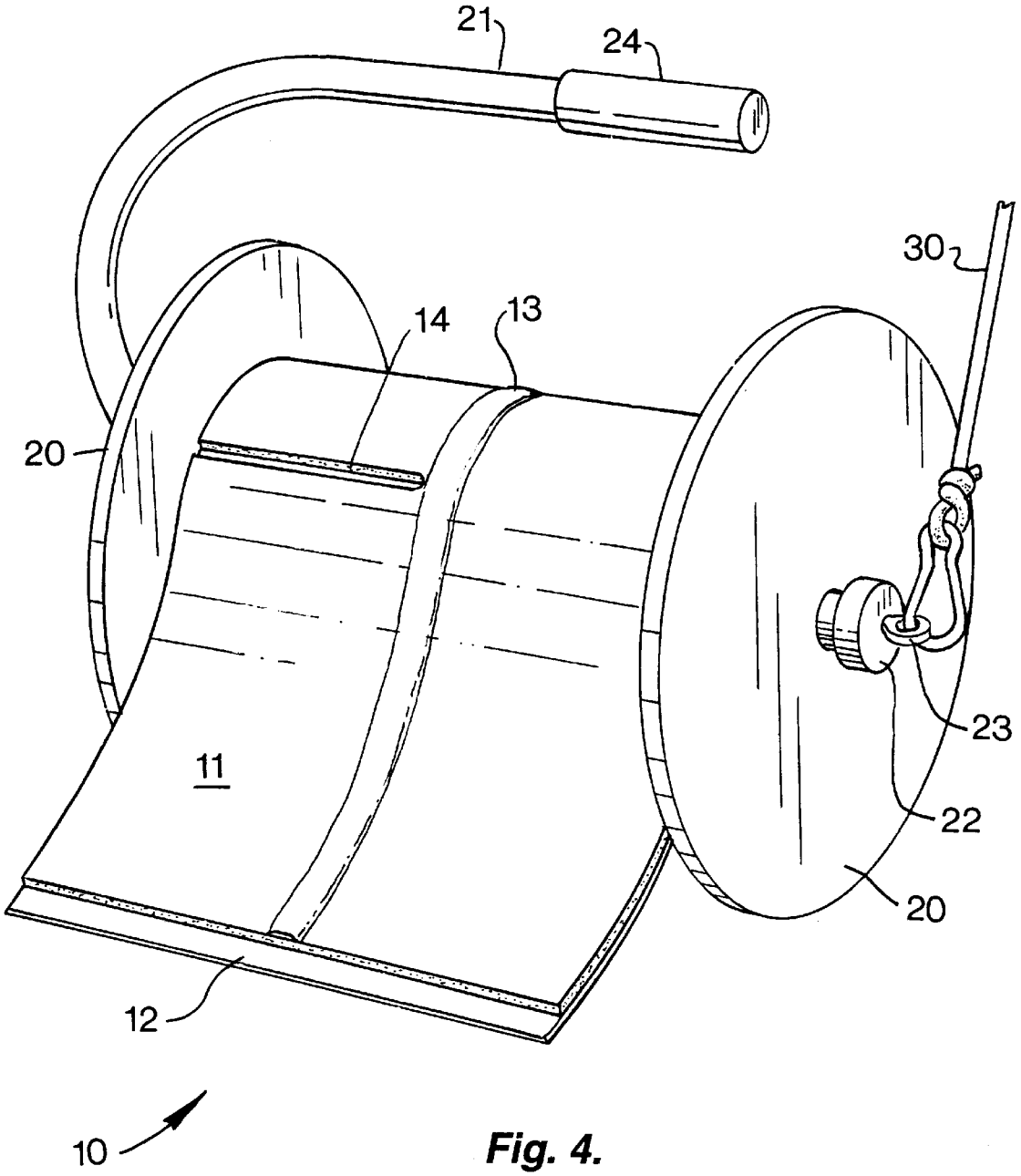
FIG. 4 is a perspective view of the handling tool according to FIG. 1, with a roll of roofing material mounted thereon and with a rope attached thereto.
Figure 5:
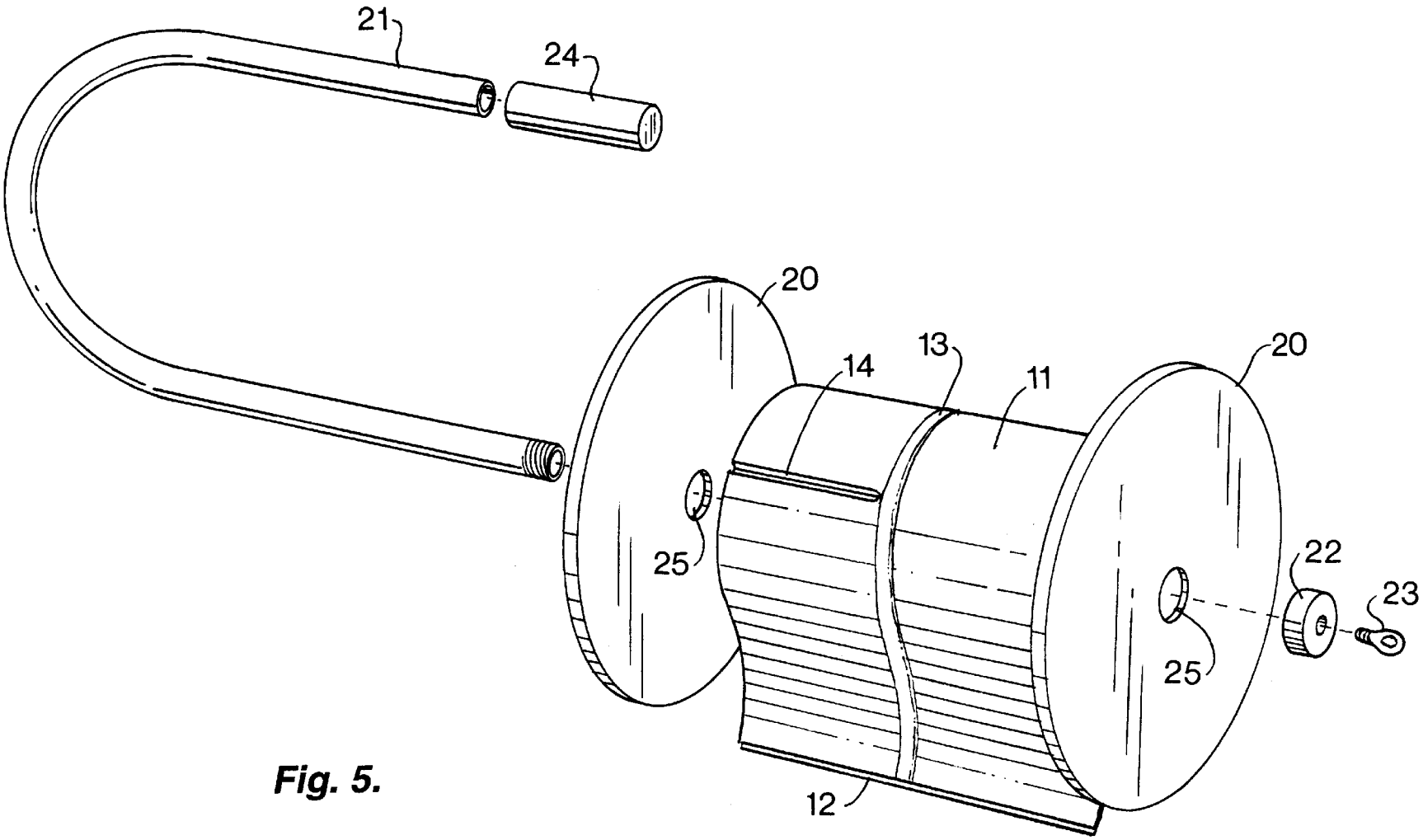
FIG. 5 is an exploded perspective view of the handling tool according to FIG. 4.

As is best seen in FIG. 2, each of the shingles 11 in the roofing material defines a pair of slots 14 each of which measures, by way of example, about ¼ inch wide and about 6 inches long. A band of thermally-activated adhesive 13 extends longitudinally across the mid-section of each shingle and is juxtaposed between it and the protective membrane 12 (FIG. 2). The shingles 11 themselves are attached to the membrane 12 in such a way that contiguous ends of the shingles are spaced apart a distance similar to the width of the slots 14.

For storage, the improved roofing material is rolled on itself so as to form a hollow core with an inner diameter of about 5 inches. A handling tool for this rolled roofing material includes a tube 21, preferably made of metal, which bent into a "U"-shape and a pair of cylindrical disks 20 fabricated of metal, plastic, wood or the like. Each of the disks 20 has a centrally disposed hole 25 formed therein for receiving a branch of the "U". In use, the disks 20 are held at the ends of the hollow core of the rolled roofing material and this branch, inserted through both disks and the hollow core, is held in assembled relation with the disks by a cap 22 which is threadedly engageable with the end of the tube 21 distal from its handle 24. In the preferred embodiment, the disks 20, which measure about 1 foot in diameter, are fabricated of metal, plastic, fiberboard or a combination thereof.

In addition, the cap 22 has an eyelet 23 affixed thereto. The eyelet 23 is sized to receive a rope or cable 30, useful in lifting a roll of roofing material 10 mounted on the handing tool. Alternately, one can use a hand grip 24 mounted on the end of the tube 21 distal from the cap 22 to carry the assembly 10.

An alternate embodiment of the assembly 10 is indicated generally by the reference number 40. In the assembly 50, the roofing material comprises a continuous piece 41 of fiberglass-reinforced bituminous material or the like topped by a layer of roofing granules.

In the preferred embodiment, the piece 41 measures, by the way of example, about 1 foot wide and, like the shingles 11, has slots 42 formed therein which are spaced apart at about one foot intervals. Precut in the piece 41 prior to it being rolled, each slot 42 measures, by way of example, about ¼ inch wide and about 6 inches long and extends inwardly and perpendicularly from one of the longitudinal edges of the piece 41.

As with the shingles 11, a track of thermally-activated adhesive 43 is placed on portions of the piece 41 which will face outwardly when it is attached to a roof. This track of adhesive 43, which is disposed away from the slots 42, is used to hold this slotted roofing material in partially overlapping rows after installation. A release sheet 44 formed of a pressure-sensitive tape is applied to the underside of the piece 41 in order to keep the adhesive 43 from bonding continguous portions of this roofing material together when it is rolled for storage (FIG. 6).

Figure 6:
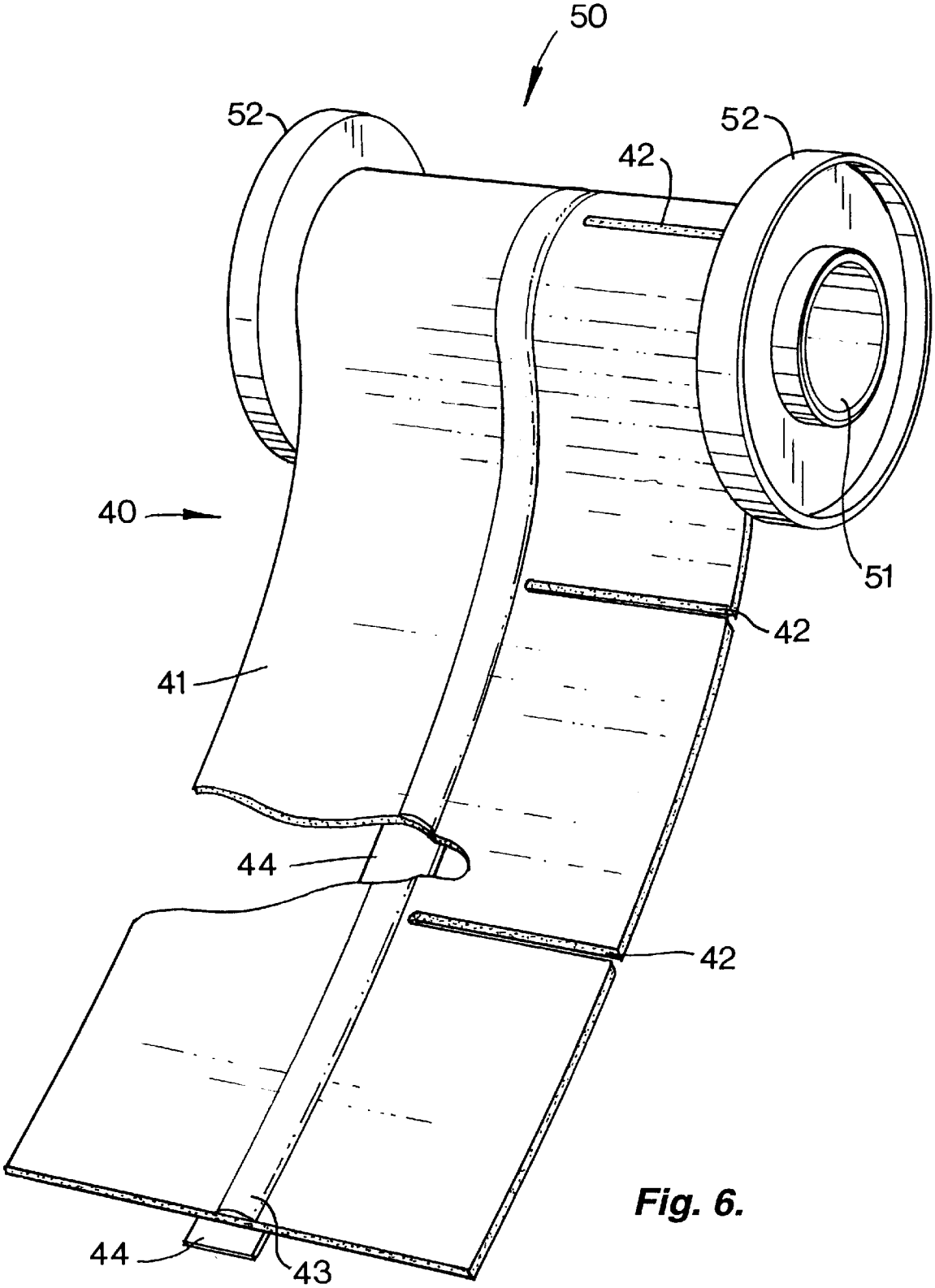
FIG. 6 is a perspective view of an alternate embodiment of the shingle roofing material, the material being shown partly unrolled with the remainder thereof mounted on a spool, the breakout section showing a release sheet for isolating the adhesive.

Means for holding the slotted piece 41 in roll form prior to use includes a spool 52 (FIG. 6). The spool 52 comprises a central cylinder 51 which, in the preferred embodiment, measures about 5 inches in diameter and about 1 foot long. A pair of disk plates, about 1 foot in diameter, rigidly attached to the ends of the cylinder 51 are useful in holding the roll of roofing material thereon. The spool can be fabricated of metal, plastic, fiberboard or a combination thereof. Alternately, the piece 41 can be rolled upon itself so as form a hollow core and the handling tool with its tube 21 and disks 20 can be mounted thereon to form an assembly (not shown) similar to the assembly 10.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. An assembly comprising:

(a) a roll of roofing material having a plurality of shingles and an elongated plastic membrance, each shingle being fabricated of bituminous material and having an outwardly facing side and an inwardly facing side; the outwardly facing side having a band of thermally-activated adhesive bonded thereto; the inwardly facing side being attached to the membrane; the shingles extending longitudinally, end to end, along the membrane, each contiguous pair of shingles being spaced apart from each other a sufficient distance to define a slot; and (b) means for hoisting the roll of roofing material, the hoisting means comprising a "U"-shaped tube defining first and second branches and a pair of cylindrical disks, each disk having a centrally disposed hole formed therein for receiving the first branch, and means for securing the roll of roofing material, the pair of cylindrical disks, and the first branch in assembled relation with the roll of roofing material being juxtaposed between the disks.

2. Rollable roofing material comprising a plurality of shingles and an elongated plastic membrane, each shingle being fabricated of bituminous material and having an outwardly facing side topped by a layer of roofing granules and an inwardly facing side; the outwardly facing side having a band of thermally-activated adhesive bonded thereto; the inwardly facing side being attached to the membrane; the shingles extending longitudinally, end to end, along the membrane.

3. An assembly comprising:

(a) a roll of roofing material defining a plurality of spaced-apart slots which extend inwardly from one side of the roofing material and an elongated plastic membrane, the roofing material being fabricated of bituminous material and having an outwardly facing side and an inwardly facing side; the outwardly facing side having a longitudinally-extending band of thermally-activated adhesive bonded thereto; the inwardly facing side being attached to the membrane; and (b) means attached to the roll of roofing material for hoisting it, the hoisting means being adapted for use with a single rope.

4. The assembly according to claim 3 in which some of the spaced-apart slots span the roofing material transversely, the roofing material being segmented and held together by the membrane.

5. The assembly according to claim 3 in which all of the spaced-apart slots span at most about one-half of the roofing material transversely.

6. The assembly according to claim 5 in which the membrane serves as a release sheet to facilitate unrolling the roofing material.

7. The assembly according to claim 3 in which the hoisting means further comprises a "U"-shaped tube defining first and second branches and a pair of cylindrical disks, each disk having a centrally disposed hole formed therein for receiving the first branch, means for securing the roll of roofing material, the pair of cylindrical disks, and the first branch in assembled relation, and means affixed to said securing means for attaching the rope.

* * * * *